US005294472A

United States Patent [19]

Arnold et al.

[11] Patent Number: 5,294,472

[45] Date of Patent: Mar. 15, 1994

[54] OBLIQUE WEB MULTIPLE SURFACE PANELS FABRICATED OF AROMATIC POLYCARBONATES

[75] Inventors: Norbert Arnold, Waldachtal; Wolfgang Wiebel, Haibach, both of Fed. Rep. of Germany

[73] Assignee: Degussa Aktiengesellschaft, Frankfurt am Main, Fed. Rep. of Germany

[21] Appl. No.: 939,599

[22] Filed: Sep. 2, 1992

[30] Foreign Application Priority Data

Sep. 4, 1991 [DE] Fed. Rep. of Germany ... 9110957[U]

[51] Int. Cl.[5] ..... B32B 7/00; B32B 1/00; E04C 2/34

[52] U.S. Cl. ..... 428/120; 428/119; 428/167; 428/172; 428/178; 428/213; 428/215; 428/219; 428/340; 52/793; 52/806; 52/807

[58] Field of Search ..... 428/178, 119, 120, 212, 428/156, 167, 172, 58, 61, 72, 213, 215, 219, 223, 340, 412; 52/793, 806, 807, 808

[56] References Cited

U.S. PATENT DOCUMENTS 3,741,857 6/1973 Kakutani et al. ..... 428/178
3,935,357 1/1975 Padovani ..... 428/178

FOREIGN PATENT DOCUMENTS 0054856 6/1982 European Pat. Off. .
2468065 4/1981 France .

OTHER PUBLICATIONS

DeGlas Panel data Sheet.
Vedril data sheet.

*Primary Examiner*—Donald J. Loney
*Attorney, Agent, or Firm*—Beveridge, DeGrandi, Weilacher & Young

[57] ABSTRACT

Oblique web multiple surface panel boards are disclosed made of aromatic polycarbonates (PC), consisting of at least two boards arranged parallel to one another at a given distance apart and joined together by webs arranged between them, one portion of the webs connecting the upper and lower board in zigzag formation, viewed in cross-section, while the other portion of the webs is attached to the upper or lower board at the junctions of the oblique webs and extends perpendicularly towards the opposite board.

5 Claims, 2 Drawing Sheets

OBLIQUE WEB MULTIPLE SURFACE PANELS FABRICATED OF AROMATIC POLYCARBONATES

INTRODUCTION AND BACKGROUND

The present invention relates to oblique web multiple surface panels, in particular webbed double surface board panels of aromatic polycarbonates or webbed multiple surface board panels in general. These consist of at least two parallel panels joined together by webs extending in particular arrangements.

The most frequent of the known panels is the webbed double panel in which the webs extend perpendicularly to the plane of the panel at regular spaced apart distances so that, when viewed in cross-section, a row of adjacent rectangular chambers is formed.

Owing to the anisotropic character of such boards with respect to their flexural strength, other geometrical forms such as, for example, the so-called framework geometry such as marketed under the trademark DEGLAS and VEDRIL have been developed in particular for products fabricated of PMMA (polymethyl methacrylate).

In these geometrical forms, the webs enclose an angle of about 45° with respect to the horizontal plane of the panel, thus providing for reduced tension forces and increased rigidity for a given weight per unit area due to improved transmission of transverse forces.

As a result of these measures, the supporting elements located between the two major parallel surfaces of the panel may be arranged further apart so that there is a saving in the amount of material necessary to form the supporting construction and a saving in the time required for its installation.

A construction similar to the PMMA framework geometries has not hitherto been realized for polycarbonate webbed panels.

The only known construction is a so-called X-board 16 mm in thickness in which two 45° webs per chamber are incorporated in the geometry in addition to the vertical webs.

Due to the additional oblique webs, this board has a weight per unit area of 3.3 kg/m$^2$, which is substantially higher than that of standard 16 mm PC webbed boards (about 2.7 to 3.0 kg/m$^2$).

It is not possible simply to apply the geometries which have been found satisfactory for the production of PMMA boards to boards made of polycarbonates due to the differences in the properties of the materials (e.g. modulus of elasticity).

Under heavy loads, the boards buckle before the maximum load is reached.

SUMMARY OF THE INVENTION

It has now been found that oblique web multiple surface board panels fabricated from aromatic polycarbonates (PC) formed of at least two boards arranged parallel to one another at a given distance apart and joined together by webs arranged between them, with one portion of the webs connecting the upper and lower panels of the board in zigzag formation, viewed in cross-section, while the other portion of the interconnecting webs are attached to the upper or lower panel at the junctions of the oblique webs and extend perpendicularly towards the opposite panel. The novel panels of the invention have a sufficient load bearing capacity since the buckling point is shifted to beyond the load limit. This is defined by the relationship such that under a load of 750 N/m$^2$ there is not more than 5% sagging, based on the width of the board.

Aromatic polycarbonate resins are well known in the art and any suitable ones may be used for purposes of this invention.

BRIEF DESCRIPTION OF THE DRAWINGS

The invention will be further understood with reference to the accompanying drawings, wherein.

BRIEF DESCRIPTION OF THE INVENTION

Figure 1:
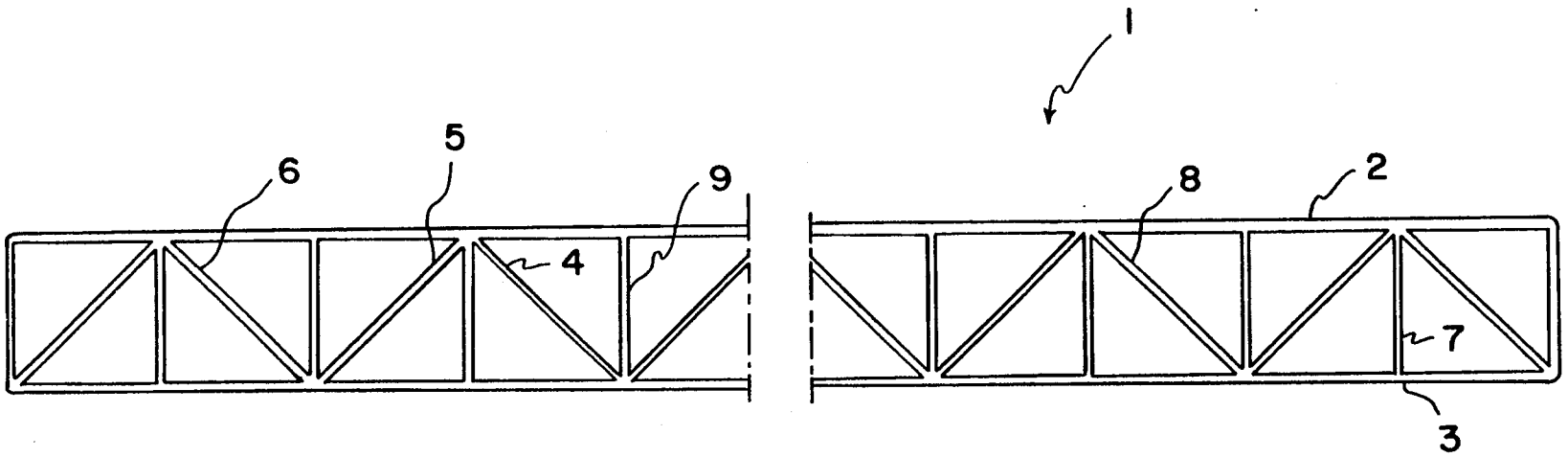
FIG. 1 shows an elevational cross-section view of a panel of the invention.

One particular embodiment of the invention as shown in FIG. 1 is an oblique web multiple surface board panel (1), in particular webbed double surface panels, which are formed of two parallel panels (2,3) of extended surface area having a thickness of, for example, about 0.7 mm. A plurality of oblique webs (4, 5, 6) each enclose an angle of about 45° with the two parallel panels (2, 3), and their thickness is, for example, about 0.4 cm. the thickness of vertical webs. In addition, there are a plurality of vertical webs (7, 8, 9) about 0.2 mm in thickness.

The distance between the last-mentioned webs is preferably about 16 mm, as is also the thickness of the webbed double boards. That is the height of the panel when viewed along the longitudinal edge is about equal to the dimension between adjacent vertical web members.

Figure 2:
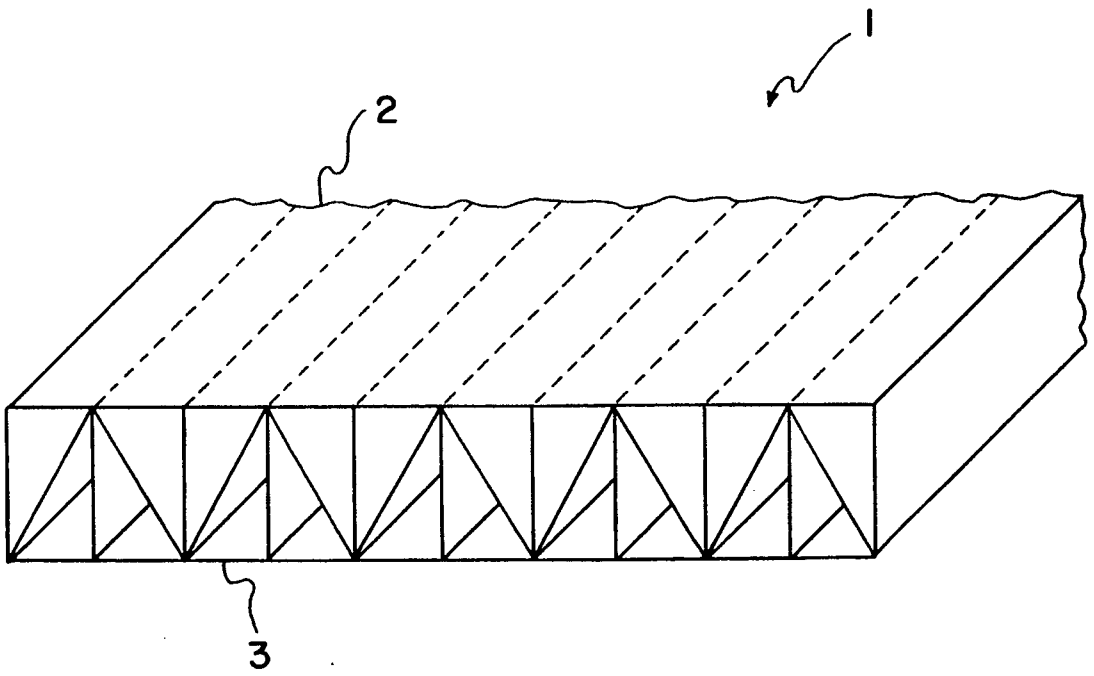
FIG. 2 shows a perspective view of a panel of the invention.

In FIG. 2 the panel of the invention (1) is shown in perspective view. The large surface area top (2) and bottom 3 panels are parallel and connected by a plurality of vertical webs (7, 8, 9). They are perpendicular to the top and bottom panels. The webs at 45° (4, 5, 6) are arranged such that each cell formed by two vertical webs (7, 8) have one inclined web at about 45°.

The closing web forming the boundary at the right and left end of the boards is preferably about 0.4 mm in thickness. With these dimensions, the weight per unit are is about 2.7 kg/m$^2$.

The oblique web multiple surface panel boards according to the invention are produced by the known process of extrusion. Suitable coatings, such as polyethylene, may, of course, be applied to the upper and/or under sides of the boards by known methods, such as coextrusion or laminating, for providing additional reinforcement or improved flame-resistance, or other specific properties.

The panels according to the invention are used for the same purposes as the known webbed double panels of the prior art.

The panels can be made to be translucent, transparent, or opaque.

German priority application G 91 10 957.4 is relied on and incorporated herein by reference.

We claim:

1. A surface panel board made of aromatic polycarbonates, consisting of at least two surface boards arranged parallel to one another at a predetermined distance apart and joined together by a plurality of webs arranged between them, one portion of said webs being oblique in relation to said boards and connecting said boards in zigzag formation, viewed in cross-section, while the remaining portion of said webs are vertical with respect to said board and are attached to said boards at the junctions of said oblique webs and said boards and extend perpendicularly between said boards, said oblique webs having a greater thickness then said vertical webs, the vertical webs being located alternatingly with said oblique webs.

2. The multiple surface panel board according to claim 1, wherein the oblique webs enclose an angle of about 45° with said boards and said oblique webs have a thickness of about 0.4 mm while the thickness of the vertical webs is about 0.2 mm and the distance between said vertical webs is about 16 mm.

3. The multiple surface panel board according to claim 2 which has a weight of about 2.7 kg/m$^2$.

4. The multiple surface panel board according to claim 2 wherein the webs forming the oblique zigzag formation are at an angle of about 45° to said boards.

5. The multiple surface panel board according to claim 2 wherein the height of the panel when viewed along its longitudinal edge is about equal to the dimension between adjacent vertical members.

* * * * *